US009221663B2

(12) United States Patent
Schwarz

(10) Patent No.: US 9,221,663 B2
(45) Date of Patent: Dec. 29, 2015

(54) CAPPING HEAD FOR SCREWING ON SCREW CAPS

(75) Inventor: Wolfhard Schwarz, Worms, DE (US)

(73) Assignee: Closure Systems Intenational Deutschland GmbH, Worms (DE)

( * ) Notice: Subject to any disclaimer, the term of this patent is extended or adjusted under 35 U.S.C. 154(b) by 858 days.

(21) Appl. No.: 13/394,363

(22) PCT Filed: Sep. 13, 2010

(86) PCT No.: PCT/EP2010/005590

§ 371 (c)(1),
(2), (4) Date: Mar. 6, 2012

(87) PCT Pub. No.: WO2011/029616

PCT Pub. Date: Mar. 17, 2011

(65) Prior Publication Data

US 2012/0159902 A1 Jun. 28, 2012

(30) Foreign Application Priority Data

Sep. 14, 2009 (DE) ..... 10 2009 042 147

(51) Int. Cl.
*B67B 3/20* (2006.01)
*B67B 3/00* (2006.01)

(52) U.S. Cl.
CPC *B67B 3/2066* (2013.01); *B67B 3/00* (2013.01)

(58) Field of Classification Search
CPC ..... B67B 3/20; B67B 7/28; B67B 3/00; B67B 3/02; B67B 3/22; B67B 3/2066; B67B 7/284; B67B 2201/10; B67B 3/2086; B65B 7/28
USPC ..... 53/317, 329, 331, 331.5, 356, 490; 383/45; 279/6, 106
See application file for complete search history.

(56) References Cited

U.S. PATENT DOCUMENTS 1,208,529 A * 12/1916 Evans ..... 279/102
1,249,025 A 12/1917 Carvalho
1,707,201 A * 3/1929 Lebherz ..... 53/368
3,906,706 A * 9/1975 Conti ..... 53/331.5
3,984,965 A * 10/1976 Sonnenberg ..... 53/331.5

(Continued)

FOREIGN PATENT DOCUMENTS

DE 19540545 A1 5/1997
DE 102007028429 A1 12/2008

(Continued)

OTHER PUBLICATIONS

International Search Report (English and German) and Written Opinion (German) for PCT/EP2010/005590, ISA/EP, mailed Nov. 16, 2011.

(Continued)

*Primary Examiner* — Gloria R Weeks
*Assistant Examiner* — Justin Citrin
(74) *Attorney, Agent, or Firm* — Wood, Phillips, Katz & Clark & Mortimer

(57) ABSTRACT

A capping head for screwing screw caps onto containers includes a center axis and a capping cone having a cavity that holds a screw cap. The capping head has a toothed profile, whose teeth essentially point in the direction of center axis. The cavity has an opening. A root diameter of the toothed profile lies on a first imaginary annular surface. A tip diameter of the toothed profile lies on a secondary imaginary annular surface. The first and second annular surfaces are arranged concentric to the center axis. The second annular surface and the center axis enclose a first angle, while the diameter of capping cone increases in the direction of opening. The first annular surface and the second annular surface enclose a second angle that is greater than 0°.

17 Claims, 2 Drawing Sheets

(56) References Cited

U.S. PATENT DOCUMENTS

| | | | | |
|---|---|---|---|---|
| 4,364,218 | A * | 12/1982 | Obrist | 53/331.5 |
| 5,054,261 | A * | 10/1991 | Gilbertson | 53/331.5 |
| 6,105,343 | A | 8/2000 | Grove | |
| 7,322,165 | B2 * | 1/2008 | Spether | 53/331.5 |
| 2005/0022479 | A1 | 2/2005 | Kitamoto | |
| 2009/0308025 | A1 * | 12/2009 | Martin | 53/317 |
| 2010/0205905 | A1 | 8/2010 | Schmatz | |

FOREIGN PATENT DOCUMENTS

| | | | | |
|---|---|---|---|---|
| EP | 0536460 | A1 | 4/1993 | |
| GB | 946153 | A * | 1/1964 | B67B 3/2066 |
| JP | 11124196 | A | 5/1999 | |
| WO | 2009/089023 | A1 | 7/2009 | |

OTHER PUBLICATIONS

English Translation of the International Preliminary Report on Patentability for PCT/EP2010/005590, IB, Geneva, issued Mar. 20, 2012.

International Search Report and Written Opinion of the ISA for PCT/EP2010/005591, ISA/EP, mailed Oct. 7, 2011.

* cited by examiner

CAPPING HEAD FOR SCREWING ON SCREW CAPS

CROSS-REFERENCE TO RELATED APPLICATIONS

This application is a 371 U.S. National Stage of International Application No. PCT/EP2010/005590, filed Sep. 13, 2010, which claims priority to German Patent Application No. 102009042147.5, filed Sep. 14, 2009. The entire disclosures of the above applications are incorporated herein by reference.

The invention concerns a capping head for screwing screw caps onto containers, especially bottles, according to the preamble of the claim 1.

Capping heads of the type discussed here are known. They are used to screw the screw cap onto the container during closure of containers with screw caps, in which case a torque in particular is transferred from the capping head to the screw cap. For this purpose the known capping heads have a center axis that simultaneously forms an axis of rotation of the capping head, as well as a capping cone having a recess that accommodates a screw cap. The design of the capping cone means that the recess has a truncated conical contour at least in the area of the capping cone, when viewed in cross section. This contour reduces the risk of jamming of a screw cap in the recess or in the capping cone. The capping cone of such capping heads generally includes a toothed profile with teeth that point essentially in the direction toward the center axis of the capping cone. Such capping heads are used for screwing on and therefore fastening of screw caps, which have corrugation in the form of protrusions or teeth on their outer surface. Through cooperation of the toothed profile and corrugation a high torque can be transferred from the capping head to a screw cap. The recess of the known capping head also has an opening through which a screw cap can be introduced at least in areas into the capping cone. A root diameter of the toothed profile lies in a first imaginary annular surface and a tip diameter of the toothed profile on a second imaginary annular surface, the first and second annular surfaces being arranged concentric to the center axis of the capping head. The second annular surface and the center axis define and enclose between them an angle $\alpha$. $\alpha$ is ordinarily chosen greater than 0° in order to prevent jamming of a screw cap. The capping cone is aligned so that it widens toward the opening. The first and second annular surfaces are then aligned parallel to each other. The known capping heads cooperate without problem only with a specific screw cap. Screwing of different screw caps onto containers with the same capping head, on the other hand, is not possible, since the unadapted screw caps would jam when screwed on in the capping cone, among other things, because of their different expansion behavior. In an automated capping machine significant damage could quickly occur on this account, since loosening of the screw cap and therefore loosening of the container from the capping machine would not be possible. The capping heads are therefore designed so that they can be replaced in simple fashion on a capping machine. The capping heads are generally provided with a thread on their end opposite the capping cone, by means of which they can be fastened in/on a corresponding receptacle of a capping machine. The provision of a specific capping head for a defined screw cap, among other things, entails shutdown times, however, caused by a capping head change during mechanical processing, which involves corresponding costs.

The task of the invention is therefore to devise a capping had of the type just mentioned, which avoids jamming and in particular permits screwing of different screw caps onto containers.

To solve this task a capping head with the features mentioned in claim 1 is proposed. The capping head is characterized by the fact that the first annular surface and the second annular surface enclose a second angle $\beta>0°$. It is therefore prescribed that an angle greater than zero lie between the first annular surface and the second annular surface so that the first annular surface and the second annular surface are not aligned parallel to each other. This means that, viewed in the direction of the center axis, the height of the teeth of the toothed profile increases. In an alternative view the depth of the tooth base viewed in the axial direction increases. The height of the teeth or depth of the tooth base expediently increases in the direction of opening of the recess so that the teeth have a greater height in the area close to the opening than in the area away from the opening lying farther inward. Because of this, the expansion behavior of the screw cap when screwed on (i.e., when fastened to the container) is taken into account. It was recognized that a screw cap expands differently in the direction of its center axis (i.e., axially) when screwed on. And specifically the screw caps expand on their outer surface in the vicinity of their closed face less extensively than close to the (threaded) opening so that during screwing on a previously u-shaped cross section at least in areas expands into a v-shaped cross section. The second angle $\beta>0°$ between the first and second annular surfaces guarantees that the screw cap can expand farther in the area close to the opening without being jammed in the capping head. The advantageous design of the capping head therefore makes it possible for different screw caps of a so-called screw cap family with the same capping head to be screwed onto containers, especially bottles. The screw caps of a screw cap family essentially differ in the design of the corrugation and the expansion behavior of the screw cap. The choice of angle $\beta>0$ makes it possible that even the screw cap of the screw cap family with the largest corrugation can still be taken up by the capping cone and screwed without jamming. The angles are chosen in particular so that expansion when screwed on does not lead to a situation in which the projections of the corrugation are forced against the tooth base or root diameter of the toothed profile of the capping head and deformed or damaged on this account. Overall, by means of the advantageous capping head, jamming and/or damage to different screw caps of a screw cap family is prevented.

In a preferred modification of the capping head it is prescribed that the angle $\alpha$ be chosen greater than 0° so that the capping cone is not merely defined or formed by the root radius of the toothed profile, but also by the tip radius of the second annular surface. The conicity of the capping cone is then also formed by the fact that the second annular surface and the center axis enclose a first angle $\alpha>0°$ and a first diameter of the second annular surface on a side facing the opening is greater than the second diameter of the second annular surface on a side facing away from the opening. Accommodation of a screw cap without jamming is therefore guaranteed by means of the advantageously shaped capping cone.

As an alternative it is conceivable that the angle $\alpha=0°$. In this case the capping cone is defined merely by the first annular surface of the toothed profile and the angle $\beta>0°$. The second annular surface, along which the tooth tips extend axially, on the other hand, is designed cylindrical. Because of this the capping cone overall can be brought particularly close to a screw cap having a cylindrical or at least cylindrical base surface. In both cases jamming of the screw cap during accommodation is also prevented by the advantageous choice of angle β.

Further embodiments and advantages of the capping head are apparent from the dependent claims.

The invention is further explained below by means of the drawing. In the drawing.

Figure 1:
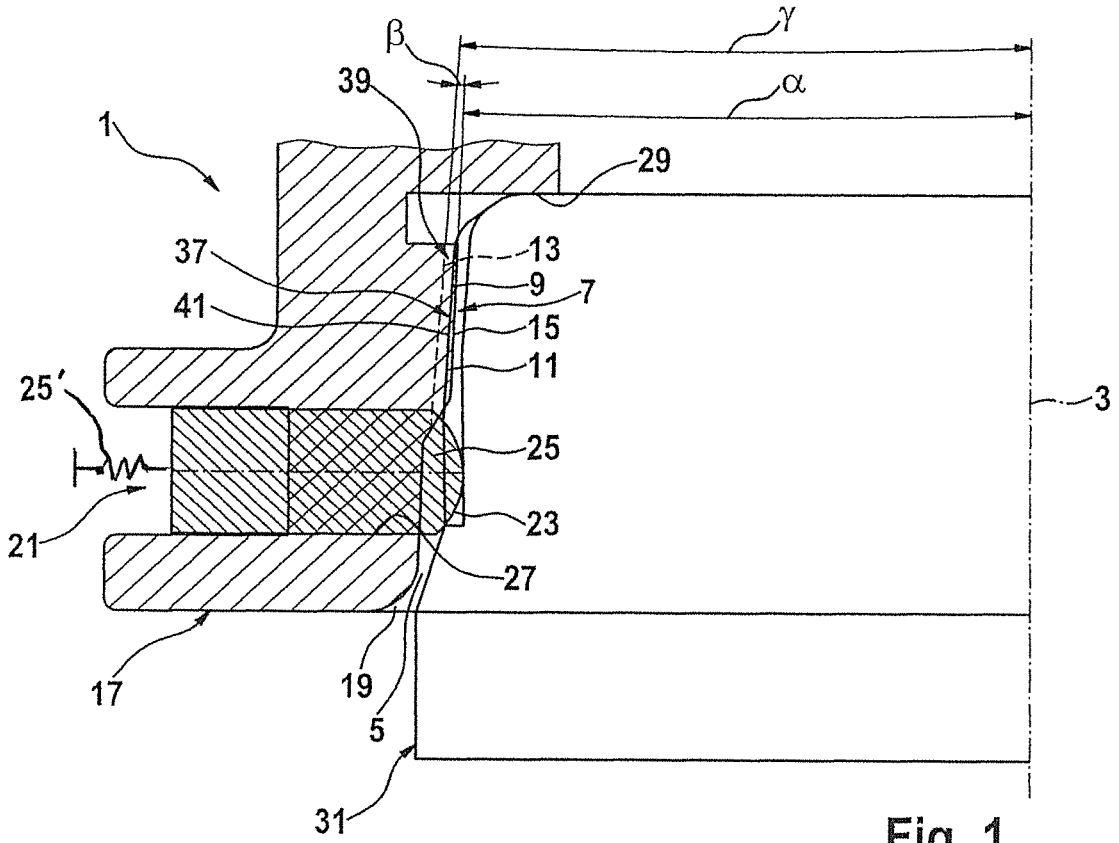
FIG. 1 shows a capping head with a screw cap of a first type.

FIG. 1 shows in a simplified cross section an area or a half of a capping head 1 for screwing (i.e., fastening) screw caps onto containers. The capping head 1 has a center axis 3 around which the capping head 1 can be placed in rotation for screwing on of a screw cap, in which case the center axis 3 forms an axis of symmetry for the essential elements of the capping head 1. The capping head 1 can be arranged on a capping machine not further shown here, which has a drive, which is effectively connected to the capping head, for example, via a driveshaft.

The capping head 1 also includes a recess 5, which has a capping cone at least in areas. The capping cone 7 is arranged concentric to the center axis of the capping head 1.

The capping cone 7 is characterized by the fact that a toothed profile 9 is provided on its inside with several teeth 11 arranged uniformly distributed over the periphery of capping cone 7. The number of teeth 11 expediently corresponds to the number of elevations or teeth on a corrugation of the screw cap being screwed on of a specific screw cap family. It is assumed here that the corrugation of the screw caps of a screw cap family always has the same number of elevations/teeth. A matching fit of the width of the teeth 11 to the corrugation, on the other hand, is not absolutely necessary and ultimately also not desired, since otherwise the compatibility with different screw caps of the screw cap family would be restricted. However, it is naturally also conceivable that the toothed profile of the capping cone 7 generally has a common divisor with the corrugation of a screw cap being screwed on of a specific screw cap family. For example, it can be prescribed that the capping cone 7 have only 12 teeth, whereas the corrugations of the screw caps of the screw cap family have 24, 60, 72, 120 or 144 teeth or elevations. It is important that intermeshing of the tooth profile and corrugation is always possible.

The teeth 11 of the toothed profile 9 preferably extend parallel to the center axis 3 and expediently point at least essentially in the direction toward the center axis 3. The dimensioning of teeth 11 of the toothed profile 9 is determined by a root diameter and a tip diameter, in which the root diameter lies on a first imaginary annular surface 13 and the tip diameter on a second imaginary annular surface 15. The first and second annular surfaces 13, 15 are then arranged concentric to the center axis 3 of capping head 1. It is therefore prescribed that the tooth tips and tooth bases of tooth 11 each lie on an imaginary annular surface 13, 15, which are arranged concentrically so that the teeth of 11 of toothed profile 9 have the same height or the tooth base has the same depth when viewed over the periphery of capping cone 7.

As is also apparent for FIG. 1, the second annular surface 15 and the center axis 3 enclose a first angle α, which is chosen greater than 0° (α>0°). Because of this the conicity of the capping cone is given. The capping head 1 on its free face 17 has an opening 19 of recess 5. The capping cone is then designed so that it widens toward opening 19. For this purpose a first diameter of the second annular surface 15 on a side facing opening 19 is greater than a second diameter of the second annular surface 15 on a side facing away from opening 19.

It is advantageously prescribed that the first annular surface 13 and the second annular surface 15 enclose a second angle β, which is also chosen greater than 0° (β>0°). Through this choice of angle β a situation is achieved for toothed profile 9 in which the height of the teeth 11 changes over their longitudinal extent, the distance between the first annular surface 13 and the second annular surface 15 being greater on its side facing opening 19 than the distance between the annular surface 13 and the second annular surface 15 on its side facing away from opening 19. In other words, the height of the teeth 11 or the depth of the tooth bases of teeth 11 of the toothed profile 9 increases in the direction toward opening 19. Ultimately this means that the first annular surface 13 and the center axis 3 enclose a third angle $\gamma=\alpha+\beta$ which is obtained directly from angles α and β.

The angles α and β are preferably chosen small so that the narrowest possible contact of the capping cone 7 against a screw cap is guaranteed. For this purpose the first angle α preferably lies in the range between 8 and 1°, especially between 5 and 2°. In particular the angle α is about 3°. The second angle β then preferably lies in the range between 1 and 5°. Because of this a maximum value of 13° and a minimal value of 3° are obtained for angle γ.

The capping head 1 also has an alignment device 21, which ensures a defined relative position between the capping cone and screw cap accommodated by recess 5. The defined relative position is at least the rotation position of the capping head relative to the corresponding screw cap. By means of the alignment device 21 it is supposed to be guaranteed that the teeth 11 of toothed profile 9 are guided into the tooth intermediate spaces of a corrugation of a screw cap when a screw cap is taken up by the recess 5. Because of this, a situation is prevented in which the corrugation of a screw cap is already damaged during the receiving process or the screw cap jams in recess 5. The receiving process is also referred to as the pick process.

The alignment device 21 preferably includes at least one alignment surface 23 that can be aligned in effective contact with the screw cap. In particular, the alignment surface 23 is designed so that it cooperates with the corrugation of the screw cap and for this purpose is arranged on the inside of recess 9. The alignment surface 23 can then be arranged in the area of the capping cone or also in an area between capping cone 7 and opening 19 of recess 5. Advantageously the capping cone 7 or toothed profile 9 is essentially directly connected to the alignment surface 23. A screw cap is positioned on this account before it comes into effective contact with the toothed profile 9.

In a variant not shown here the alignment surface 23 is provided at least on one tooth 11 of the toothed profile 9. In the first place, the alignment surface 23 therefore is situated in the area of the capping cone 7 or toothed profile 9 and, on the other hand, is formed by the toothed profile 9 itself. The alignment surface 23 in this case can be characterized by the fact that it has a wedge-like centering tip in the direction of opening 19 on an end of the corresponding tooth 11 of toothed profile 9 facing the opening.

As an alternative to this, as shown in FIG. 1, the alignment surface 23 is provided on a pick element 25. The alignment surface 23 can then be shaped as described above. The pick element 25 is preferably mounted to move on capping cone 1. For this purpose the capping cone 1 has at least one lateral recess, which discharges into recess 5. In other words, the recess 5 in its outer surface has recess 27 in which the pick element 25 is mounted to move. The pick element 25 is preferably movable radially with reference to the center axis at least essentially. In order to guarantee cooperation with a screw cap, the pick element 25 is biased in the capping cone 1 or in the recess 27, for which purpose at least one spring element 25' (FIG. 1) is provided. The spring element exerts a force on the pick element 25 directed in the direction of recess 5 or the direction of a screw cap present in the recess 5. The biased movability of pick element 25 and therefore the alignment surface 23, in the first place, permits alignment of the screw cap relative to the capping head and, in the second place, prevents damage to the screw cap when it is taken up in a rotational position of the recess 5 unfavorable for alignment. Such a situation can develop, for example, when the alignment surface 23 precisely encounters a tooth of the corrugation of a screw cap. The pick element 25 can be forced back into the capping head 1 and, after slight rotation of the capping head and/or the screw cap, will penetrate into a tooth intermediate space of the corrugation of the screw cap.

The spring element is preferably an elastically-deformable element, which is formed with particular preference by a simple coil spring or also by an annular or strip spring or an O ring, each of which extends over the entire periphery of the capping head. The strip spring can then also bias additional pick elements of the alignment device corresponding to pick element 25, which can be distributed over the periphery of the capping head. The one or several pick elements can also serve for centering of a screw cap in the recess 5 or in capping cone 7.

It is also apparent from FIG. 1 that a stop 29 is provided, which forms the end of the recess 5 opposite opening 19. It limits penetration of a screw cap into capping cone 7. In particular, it prevents a screw cap from being pushed so far into the capping cone 7 or into recess 5 that it is jammed and/or the toothed profile 9 is forced against an area of the screw cap that is no longer provided with corrugation so that this area, for example, a warranty ring of the screw cap could be damaged. The stop 29 also prevents tilting or wobbling of a screw cap in the capping cone 7. The stop 29 can then be formed, for example, as a closed bottom surface of recess 5, in which case the recess 5 has an essentially cup-like cross section.

In the variant of the advantageous capping head 1 depicted in FIG. 1, the stop 29 is designed annular so that a screw cap introduced into recess 5 or into capping cone 7 comes in contact with its closed face only in areas, namely in annular fashion with stop 29. The stop then extends in annular fashion over the entire periphery of recess 9 so that a flat support is created for the screw cap. As an alternative to this. the stop 29 could also be formed by several protrusions distributed over the periphery, especially uniformly distributed over the periphery.

In the variant depicted in FIG. 1 stop 29 is designed as a fixed stop 29 with reference to capping head 1. However, an alternative design is also conceivable in which the stop 29 is mounted to move axially in the direction of the center axis. Because of this the stop 29 cannot only be adapted to different heights of the screw caps and used for limitation of penetration of the screw cap into the capping cone 7, but also for driving out a screw cap from the capping cone 7 or from recess 5. The moving stop then functions as an ejector or plunger, in which at least one actuator can expediently be provided for this purpose on the capping head 1, which is effectively connected to the moving stop for ejection of a screw cap.

The function of the capping head 1 will be explained below with reference to the practical examples depicted in FIGS. 1 and 2 with different screw caps of a screw cap family. The capping head 1 depicted in FIG. 2 corresponds to the capping head 1 depicted in FIG. 1 so that already known elements are provided with the same reference numbers and in this respect the aforementioned description is referred to.

Figure 2:
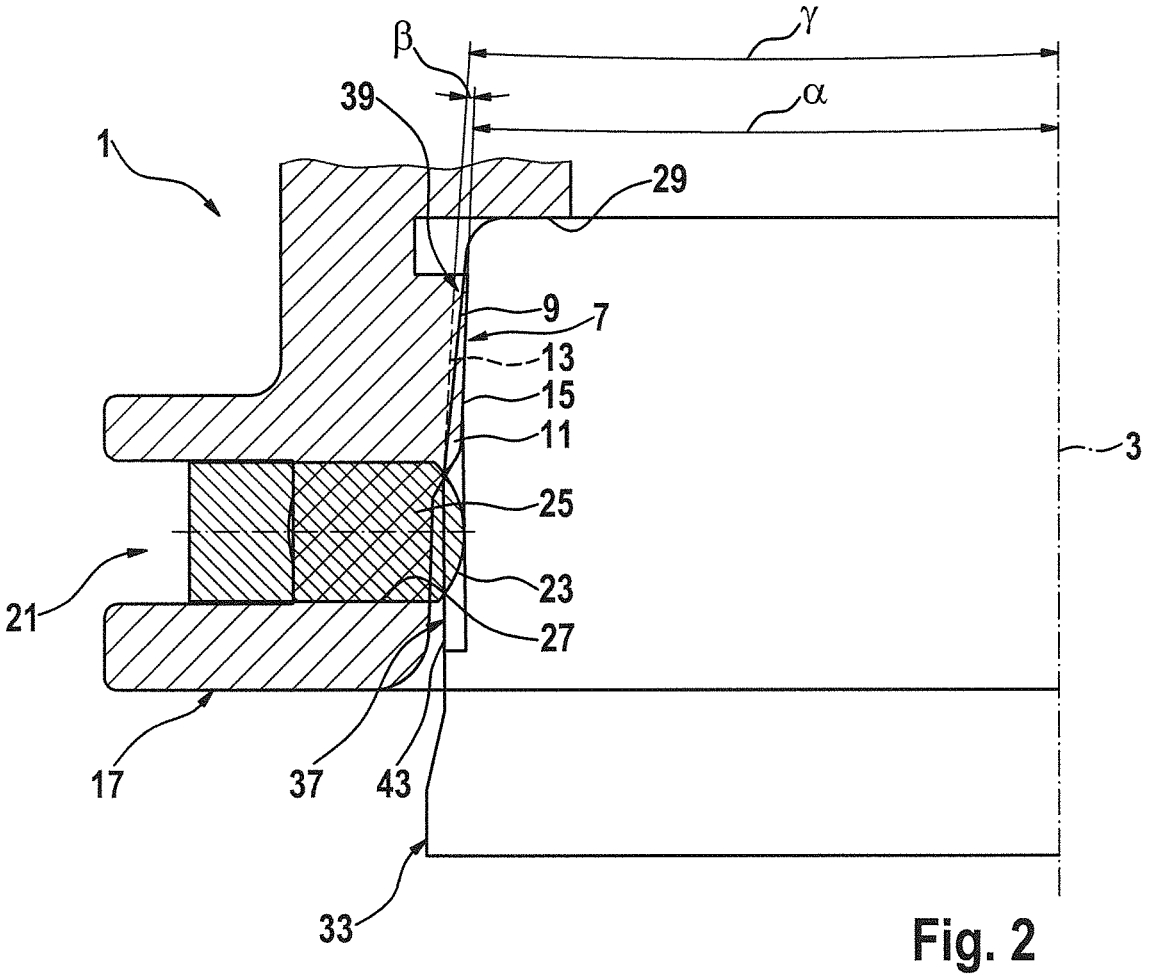
FIG. 2 shows the capping head with a screw cap of a second type of the same screw cap family.

FIGS. 1 and 2 each show a screw cap 31 (FIG. 1) or 33 (FIG. 2), which belongs to a screw cap family. The screw caps 31, 33 of the screw cap family have the common feature that they have on their outer surface 37 a corrugation 39 with the same number of teeth 41 or 43. Whereas the teeth 41 of screw cap 31 have essentially the same height when viewed in their longitudinal extent, the height of the teeth 43 of screw cap 33, however, diminishes in the direction of the closed face of the screw cap 33. According to FIG. 2 the teeth 43 have an at least essentially wedge-like longitudinal cross section in the state introduced to capping cone 7 in the area of capping cone 7.

Moreover, the root radius of teeth 43 corresponds essentially to the tip radius of teeth 11 of toothed profile 9 of capping head 1. On the other hand, the root radius of teeth 41 of screw cap 31 is made smaller. In both cases the tip radii of teeth 41 and 11 or 43 and 11 overlap. It is important that the maximum root radius of teeth 11 is greater than the maximum tip radius of the protrusions of corrugation 39 so that the latter is not damaged, at least not visibly. The maximum root diameter is then advantageously chosen as a function of the material of a screw cap being screwed on of a family in order to allow for different expansion behavior of the screw caps when screwed on.

For screwing on the capping head 1 is introduced onto the screw cap 31 or 33 or the screw cap 31 or 33 introduced into the capping head 1. In this case the rotational position of the corresponding screw cap 31, 33 with reference to capping head 1 is initially ensured by means of alignment device 21, as described above. On further introduction of the screw cap 31, 33 into recess 5 the corresponding corrugation 39 and the toothed profile 9 come into effective contact. The screw cap 31, 33 is pushed into the stop 29.

Whereas the same capping head 1 is shown in FIGS. 1 and 2, the screw caps 31, 33 are characterized by different sizes. The smaller screw cap 31 is the smallest screw cap (min screw cap) and the largest screw cap 33 the largest screw cap (max screw cap) of the screw cap family so that, as is apparent from FIGS. 1 and 2, the tooth tips of teeth 11 lie against the root radius of the screw cap 33, whereas the tooth tips of teeth 43 lie at a spacing from the root radius of teeth 11. The tooth tips of corrugation 39 are protected from damage on this account. The teeth 41 of screw cap 31, on the other hand, only overlap over a small area with teeth 11 of capping cone 7. A torque can then be reliably transferred from the capping head 1 to the screw cap 31 or 33 via the tangentially produced contact surfaces.

Because of the advantageous choice of angle with angle $\beta>0°$ introduction and tightening of the screw caps 31, 33 of the screw cap family is possible without the hazard of jamming of the corresponding screw cap 31, 33. By advantageous choice of the angle $\alpha=3°$ and especially angle $\beta=5°$, during screwing on a larger widening of the screw caps 31, 33 in the area near the opening is made possible without the tips of corrugations 39 coming into contact with the tooth bases of toothed profile 9 so that jamming is prevented during screwing on, despite the different expansion behavior.

The capping head 1 can therefore be used for several different screw caps of a screw cap family. This significantly simplifies automatic/mechanical screwing on of screw caps onto containers, especially bottles. Moreover, screw caps, whose optical impression is important, for example, screw caps of cosmetic products, can also be tightened with the capping head 1, since damage to the corrugation is prevented.

The invention claimed is:

1. A capping head for screwing screw caps onto containers, the capping head comprising:

a center axis; and a capping cone comprising an inner surface defining a recess for accommodating a screw cap, a toothed profile with axially aligned teeth, each of said teeth having a base and a tip, wherein the tip extends from the base in an inwardly radial direction, the recess having an opening, a diameter of the capping cone increasing toward the opening;

wherein the toothed profile is defined by a first annular reference surface coplanar with the base of said teeth, and a second annular reference surface tangential with the tips of said teeth, wherein a height of the teeth is defined by the distance between the first annular reference surface and the second annular reference surface;

wherein the first and second annular reference surfaces are arranged concentric to the center axis and diverging from each other approaching the opening, such that the height of said teeth increases in the direction toward said opening;

wherein the second annular reference surface and the center axis enclose a first angle; and wherein the first annular reference surface and the second annular reference surface enclose a second angle, the second angle being greater than 0°.

2. The capping head according to claim 1, wherein the first angle is greater than or equal to 0°.

3. The capping head according to claim 1 wherein the first annular surface and the center axis enclose a third angle, the third angle being equal to a sum of the first angle and the second angle.

4. The capping head according to claim 1, wherein the second angle lies in a range between 1° and 5°.

5. The capping head according to claim 1, wherein the first angle lies in a range between 8° and 1°.

6. The capping head according to claim 1, wherein the first angle lies in a range between 5° to 2°.

7. The capping head according to claim 1, wherein the first angle is about 3°.

8. The capping head according to claim 1, further comprising a stop that limits penetration of the screw cap into capping cone.

9. The capping head according to claim 8, wherein the stop is annular.

10. The capping head according to claim 8, wherein the stop is fixed.

11. The capping head according to claim 1, further comprising an alignment device, which ensures a defined relative position between the capping cone and the screw cap.

12. The capping head according to claim 11, wherein the alignment device has an alignment surface that cooperates with the screw cap.

13. The capping head according to claim 12, wherein the alignment surface is provided on at least one of the teeth.

14. The capping head according to claim 12, wherein the alignment surface is provided on at least one pick element.

15. The capping head according to claim 14, wherein the at least one pick element is biased by a spring element in the capping cone and/or in the recess.

16. The capping head according to claim 15, wherein the spring element is selected from a group consisting of a strip spring and an O ring.

17. The capping head of claim 15, wherein the spring element radially loads the screw cap with a force.

* * * * *